US008742953B1

(12) United States Patent
Snyder et al.

(10) Patent No.: US 8,742,953 B1
(45) Date of Patent: Jun. 3, 2014

(54) MARINE FUEL SYSTEM WITH OVERFILL ALERT

(75) Inventors: Matthew W. Snyder, Fond du Lac, WI (US); Aaron J. Ward, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 31 days.

(21) Appl. No.: 13/591,441

(22) Filed: Aug. 22, 2012

(51) Int. Cl.
*G08B 23/00* (2006.01)
*G08B 21/00* (2006.01)

(52) U.S. Cl.
USPC ..... 340/984; 340/612; 340/616

(58) Field of Classification Search
USPC ..... 340/611, 612, 616, 618, 623, 624, 984; 137/557, 558, 587; 73/1.73, 313
See application file for complete search history.

(56) References Cited

U.S. PATENT DOCUMENTS

| | | | | |
|---|---|---|---|---|
| 5,043,727 | A * | 8/1991 | Ito | 340/984 |
| 5,181,022 | A * | 1/1993 | Schupp | 340/616 |
| 5,229,766 | A | 7/1993 | Hargest | |
| 5,485,740 | A * | 1/1996 | Lippmann et al. | 73/1.73 |
| 5,950,688 | A | 9/1999 | Langlois | |
| 6,326,895 | B1 * | 12/2001 | Hartke et al. | 340/612 |
| 7,380,542 | B1 | 6/2008 | Herrington | |
| 8,181,502 | B2 * | 5/2012 | Loodberg | 73/1.73 |
| 2004/0149003 | A1 * | 8/2004 | Nestvall | 73/1.73 |

* cited by examiner

*Primary Examiner* — Van T. Trieu
(74) *Attorney, Agent, or Firm* — Andrus Intellectual Property Law LLP

(57) ABSTRACT

A marine fuel system and method includes receiving a fuel level signal from a fuel level sensor for a marine fuel tank on a marine vessel and discriminating between condition A comprising an increase in the true amount of fuel in the fuel tank above a given level, and condition B comprising a transient increase in the level of fuel in the fuel tank above the given level due to vessel movement, which may include movement due to waves, rough water, people moving on the vessel, and so on, while the vessel is stationary at a dock or filling station and being re-fueled. An alert signal is output in response to condition A and not to condition B.

28 Claims, 4 Drawing Sheets

MARINE FUEL SYSTEM WITH OVERFILL ALERT

BACKGROUND AND SUMMARY

The disclosure relates to marine fuel systems.

Marine fuel systems are known for a marine internal combustion engine for a vessel in a body of water and subject to movement, including due to waves, rough water, people moving on the vessel, etc. The system includes a fuel tank containing fuel subject to sloshing action due to the vessel movement, and including a fuel filler inlet for adding fuel to the fuel tank, and a fuel level sensor in the fuel tank and outputting a fuel level signal to a fuel gauge, e.g. at the helm. Marine fuel tanks are typically directly vented to atmosphere using a vent tube that typically runs through the hull of the vessel. When an operator, including a dock attendant, fills the fuel tank, it can overfill before the fuel pump shut-off shuts off the flow. This overfilling causes raw liquid fuel to spew out of the fuel tank vent.

Typically, the fuel level is determined by the user looking at the fuel gauge. However, the fuel gauge is typically at the helm of the vessel and not near the fuel filler inlet. This in turn requires two people to fill the vessel fuel tank to a given fuel level, one to watch the gauge, and the other for operating the fuel pump on the dock or filling station.

To avoid overfilling, where a second person may not be readily available, some boaters prefer to not fill their fuel tank completely or to a given preferred level, but rather only fill the tank to a lower predetermined level, to allow them to carry enough fuel for a day's usage, and any emergencies if possible. In another alternative, the fuel tank is provided with a fuel gauge and/or shut-off at the filler inlet, but this may be objectionable as to cost because such integrated gauges/shut-offs can be expensive.

The present disclosure arose during continuing development efforts in the above technology. In one aspect, the disclosure uses existing hardware, without expensive add-ons, to allow a single user to fill his marine fuel tank without overfilling.

DETAILED DESCRIPTION

Figure 1:
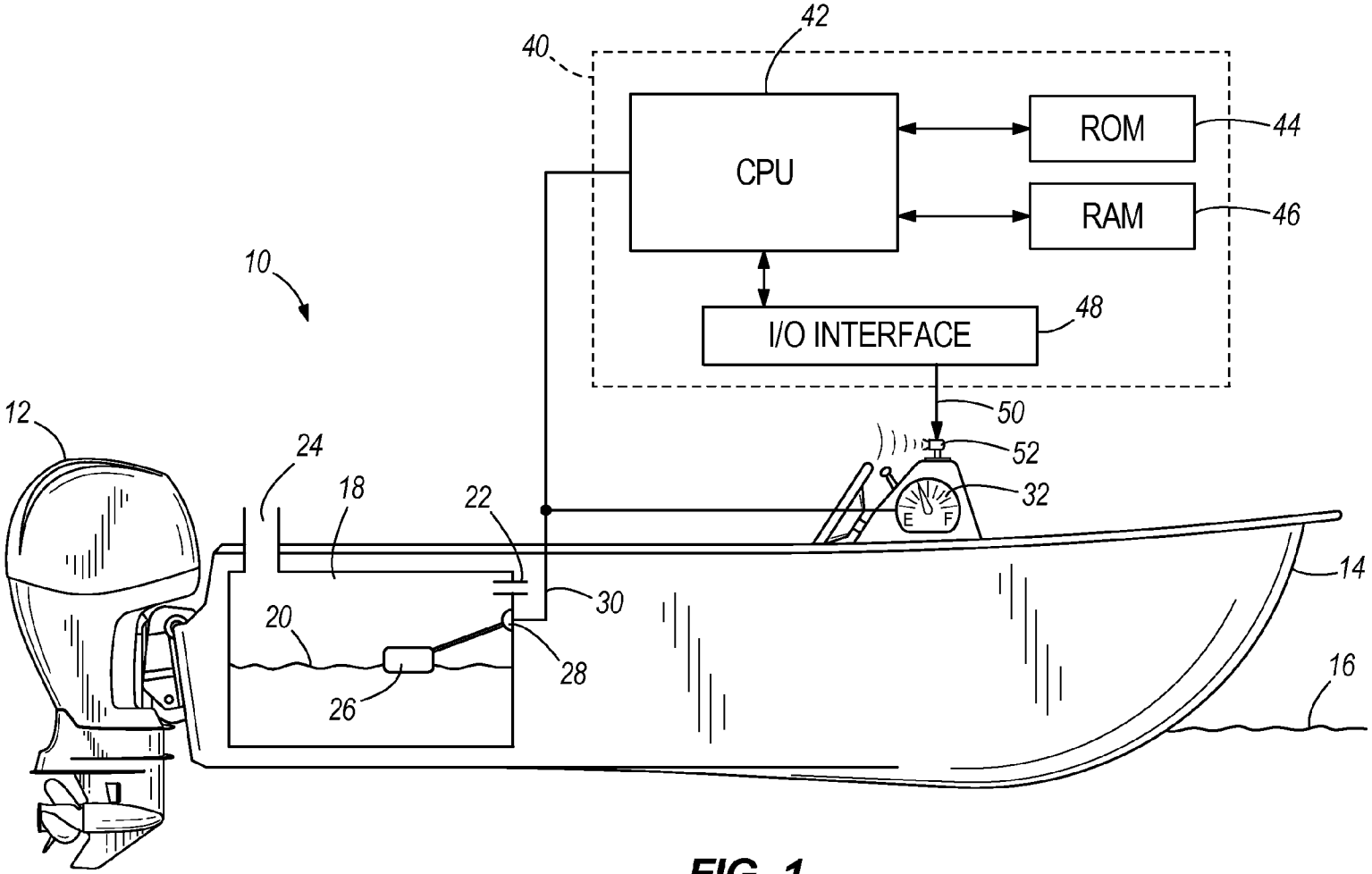
FIG. 1 is a schematic diagram of a marine fuel system.

FIG. 1 shows a marine fuel system 10 for a marine internal combustion engine 12, which may be an outboard marine drive, a stern drive, or other marine drive, for a vessel 14 in a body of water 16 and subject to movement, including due to waves, rough water, people moving on the vessel, and so on, including movement at a dock or fuel filling station. A fuel tank 18 contains fuel 20 subject to sloshing action due to vessel movement. The fuel tank has a vent outlet 22, which may be vented to atmosphere through a vent tube (not shown) as noted above. The tank has a fuel filler inlet 24 for adding fuel to the fuel tank. A fuel level sensor 26, which in one embodiment is in the fuel tank, e.g. a float hinged at pivot 28, outputs a fuel level signal at 30. The fuel level signal is supplied to a fuel gauge 32, typically at the helm of the vessel, and typically at a location not readily observable by an operator adding fuel to the fuel tank 18 at fuel filler inlet 24.

A discrimination control circuit 40, including a central processing unit, CPU, 42, ROM 44, RAM 46, and input/output, (I/O), interface 48, receives the fuel level signal and discriminates between condition A comprising an increase in the true amount of fuel in the fuel tank above a given level, and condition B comprising a transient increase in the level of fuel in the fuel tank above the given level due to vessel movement, and outputs an alert signal at 50 in response to condition A and not to condition B. The discrimination control circuit reads condition A as a true-fill to the noted given level, and reads condition B as a false-fill and avoids false triggering of the alert signal. An alarm 52 is actuated by the alert signal and alerts the operator thereto regardless of the operator's observation or non-observation of fuel gauge 32. In one embodiment alarm 52 emits an audible alert in response to alert signal 50, though other types of alerting alarms may be used, e.g. visual, as flashing lights, haptic, vibratory, and so on.

Figure 2:
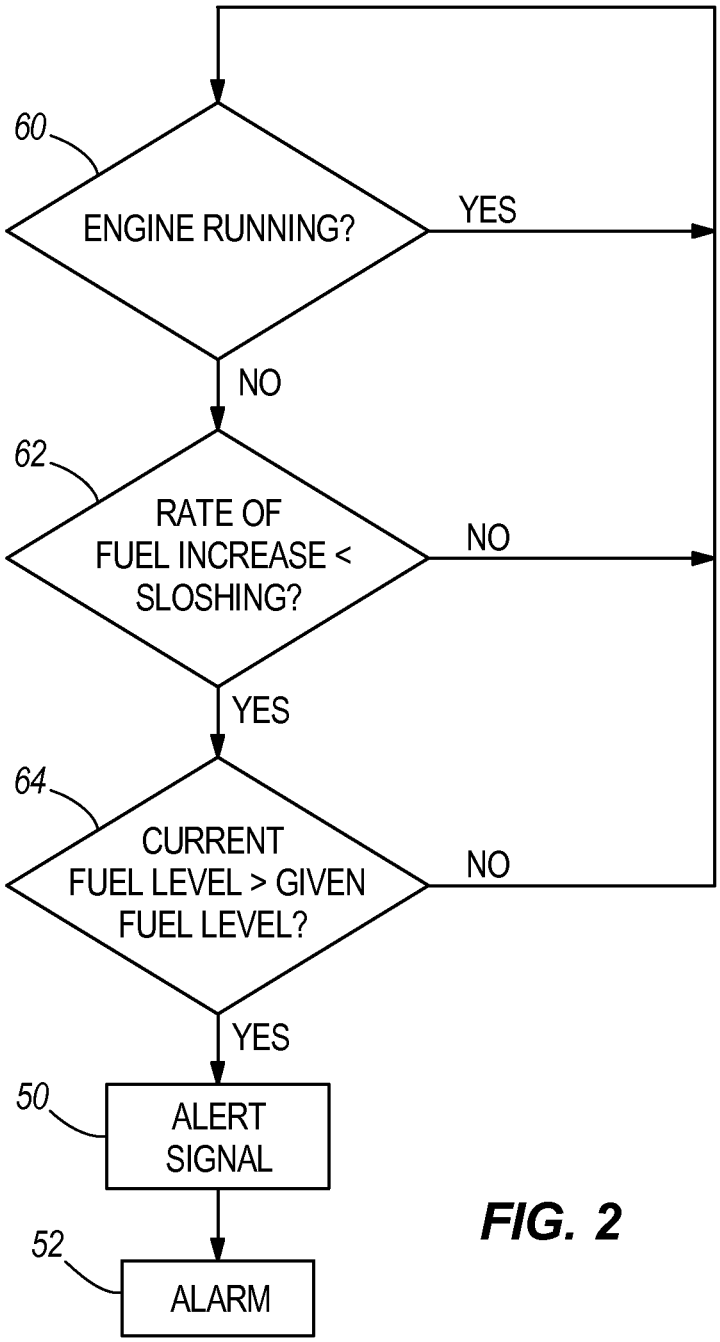
FIG. 2 is a block diagram flowchart showing a method for avoiding overfilling a marine fuel tank.

In one embodiment, FIG. 2, the discrimination control circuit determines, at step 60, if the engine is running, and if no, then at step 62 determines if the fuel level in fuel tank 18 as read from fuel level signal 30 is increasing at a rate that can only be done during fueling without sloshing due to vessel movement, and, if yes, then at step 64 compares current fuel level to the desired noted given fuel level, and outputs the alert signal at 50 to alarm 52 when the noted given fuel level is met.

Figure 3:
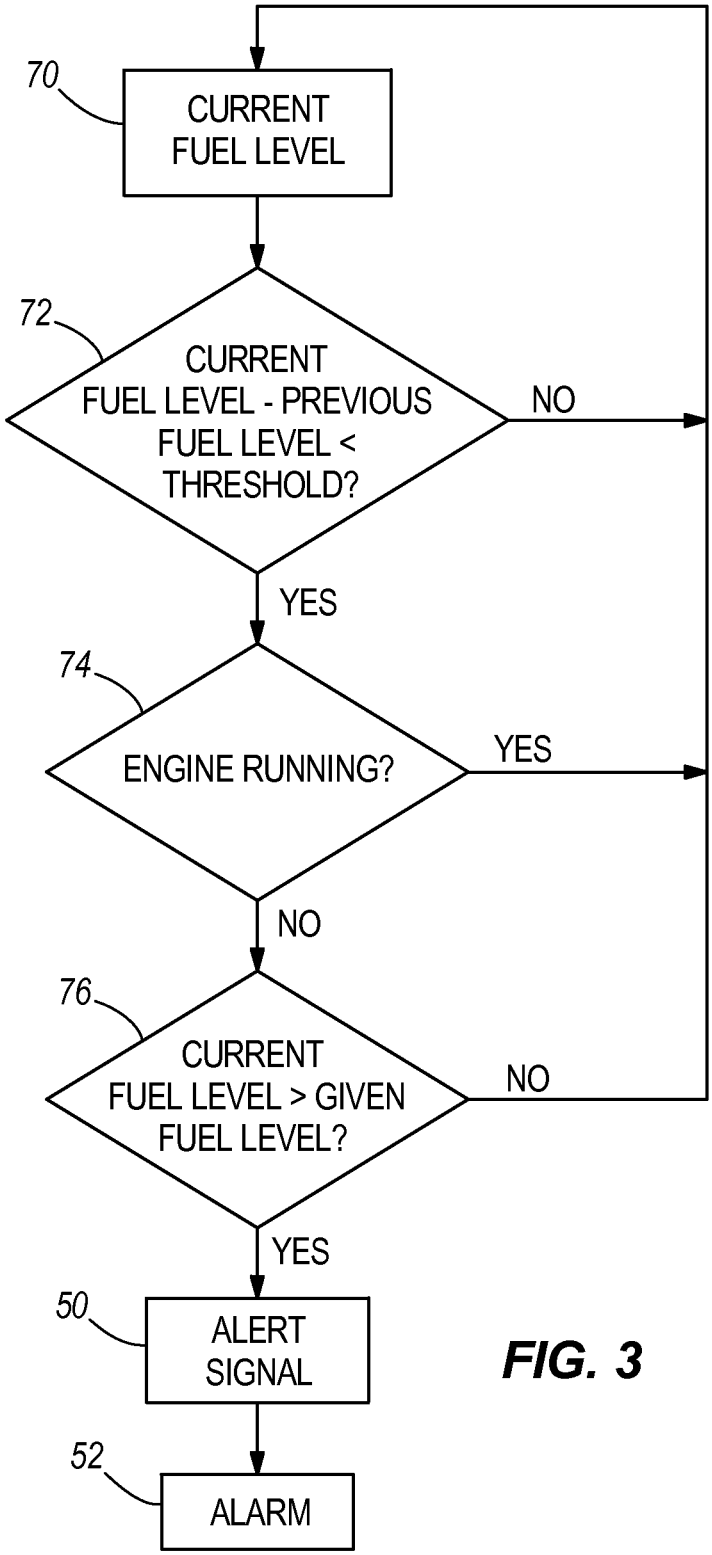
FIG. 3 is like FIG. 2 and shows another embodiment.

In another embodiment, FIG. 3, the discrimination control circuit determines at step 70 the current fuel level in fuel tank 18 as read from fuel level signal 30, and at step 72 determines if the current fuel level minus a previous fuel level is greater than a threshold. The time gap between the previous fuel level reading and the current fuel level reading is chosen to be short enough so that the delta or difference between the current fuel level and the previous fuel level can only be above the noted threshold when sloshing has occurred, e.g. fuel sensor float 26 has risen vertically rapidly due to sloshing of fuel, and not due to the slower rising of fuel level in fuel tank 18 due to filling. If the current fuel level minus the previous fuel level is less than the threshold as determined at step 72, then a determination is made at step 74 as to whether the engine is running, and if no, then at step 76 it is determined if the current fuel level is greater than the noted desired given fuel level, and if yes, then the alert signal is output at 50 to alarm 52. In another embodiment, the discrimination control circuit filters the fuel level signal 30 to prevent false triggering of alert signal 50 by the noted transient increase.

The above methodology may be suitable where the maximum flow rate of the fuel dispenser is used, and the fuel tank size and shape is known. In other embodiments, where the flow rate of the fuel dispenser may vary and/or where the fuel tank size may not be known and/or where the fuel tank may not be symmetrical and/or the shape of the fuel tank may not be known and/or the fuel tank shape or other characteristic may cause the fuel level to increase at different rates depending on the current level of the fuel in the fuel tank, a different methodology may be desired, including as now described in FIG. 4.

Figure 4:
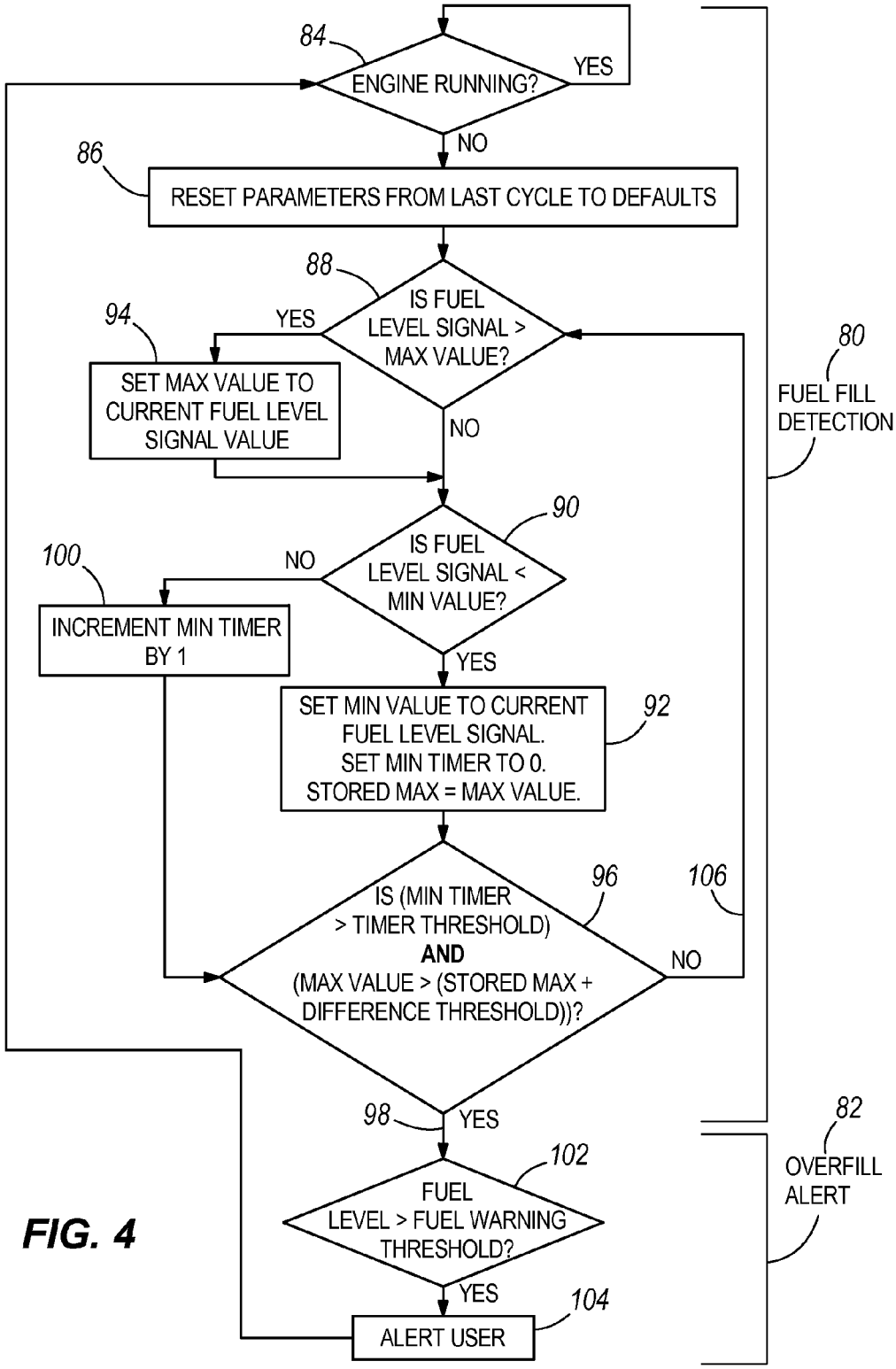
FIG. 4 is like FIG. 2 and shows another embodiment.

FIG. 4 shows a methodology for solving a frequent problem that occurs when filling a marine vessel fuel tank 18. When the fuel reaches the top of the fuel tank, it will often overflow from the vent port 22 which is typically lower than the fill point 24. The methodology includes two parts, including a fuel fill detection portion 80, and a fuel overfill alarm or alert portion 82. At step 84, it is determined whether the engine is running. If yes, it is assumed that the system is not in fill mode, and the overfill alarm or alert is not activated, and the loop simply returns to the beginning. If the engine is not running, then at step 86 variables are set to an initial state, e.g.

reset parameters from the last cycle or to defaults, to be described. A loop is then entered which tracks the minimum and maximum fuel level in the fuel tank. If the fuel level drops below the last recorded minimum value (MinValue) then the MinValue is set to the current value, the timer is reset, and the stored maximum value (StoredMax) is set to the current maximum value (MaxValue). At step 88 it is determined if the fuel level, i.e. the value of the fuel level signal, is greater than MaxValue, and if not, then at step 90 it is determined if the fuel level signal value is less than MinValue, and if yes, then at step 92 MinValue is set to the current fuel level signal value, the minimum timer (MinTimer) is set to zero, and StoredMax is set to MaxValue. StoredMax is the value of the maximum value at the point in time when the last MinValue was acquired. If at step 88, it is determined that the fuel level is greater than the last recorded MaxValue, then at step 94 the MaxValue is set to the current fuel level signal value. At step 96, if the fuel level has not dropped below MinValue for long enough for the timer to cross its threshold (e.g. in one embodiment 10 to 20 seconds) and MaxValue has increased by a designated or calibratable amount (difference threshold) above StoredMax, then the fuel tank is considered to be in filling mode as shown at yes link 98. If at step 90 the fuel level is not below MinValue, then at step 100 the MinTimer is incremented by 1, e.g. in one embodiment 1 second where the sampling rate is 1 second. If the system is deemed in filling mode as shown at 98, then at step 102 it is determined if the fuel level is greater than a fuel warning threshold or given fuel level, and if so then an alert signal is output at step 104, e.g. to alert the user, e.g. by an audible alarm as at 52 above, or other alert as noted above.

The present system provides a method for avoiding overfilling a marine fuel tank in a marine fuel system for a marine internal combustion engine for a vessel in a body of water and subject to movement, including due to waves, the fuel tank containing fuel subject to sloshing action due to the vessel movement, the fuel tank having a fuel filler inlet for adding fuel to the fuel tank, and a fuel level sensor in the fuel tank and outputting a fuel level signal. The method includes receiving the fuel level signal and discriminating between condition A comprising an increase in the true amount of fuel in the tank above a given level, and condition B comprising a transient increase in the level of fuel in the tank at the sensor above the give level due to the vessel movement, and outputting an alert signal in response to condition A and not to condition B. The method includes reading condition A as a true-fill to the given level, and reading condition B as a false-fill and avoiding false triggering of the alert signal. The method includes supplying the fuel level signal from the sensor to a fuel gauge in the vessel at a location not readily observable by an operator adding fuel to the tank at the fuel filler inlet, and actuating an alarm in response to the alert signal and alerting the operator thereto regardless of the operator's observation or non-observation of the fuel gauge. In one embodiment, the method includes emitting an audible alert from the alarm in response to the alert signal. In one embodiment, the method includes determining if the engine is running and if fuel level in the tank is increasing at a rate than can only be done during fueling without sloshing due to the vessel movement, and comparing current fuel level in the tank to the desired given fuel level, and outputting the alert signal when the given fuel level is met. In another embodiment, the method includes determining current fuel level in the tank, determining if the current fuel level minus a previous fuel level is less than a threshold, and if yes, determining if the engine is running, and if no, determining if the current fuel level is greater than the noted desired given fuel level, and if yes, outputting the alert signal. In another embodiment, the method includes filtering the fuel level signal from the sensor to prevent false triggering of the alert signal by the noted transient increase. In another embodiment, the method includes ignoring condition B by integrating the fuel level signal.

The present system further provides a method comprising entering a loop, FIG. 4, tracking minimum and maximum fuel levels indicated by the fuel level signal 30 from the fuel level sensor, and if the indicated fuel level has not dropped below a minimum value for a given interval, and if the indicated fuel level has increased by a designated amount above a maximum value, steps 90, 96, then deeming the system to be in a filling mode 98, and outputting the alert signal 104 when the indicated fuel level rises above a given fill level, step 102. The method includes:

a) determining, step 88, if the indicated fuel level is greater than a maximum value, and
   a1) if yes, step 94, then setting the maximum value to the current indicated fuel level, and proceeding to step b,
   a2) if no, then proceeding step b,
b) determining, step 90, if the indicated fuel level is less than a minimum value, and
   b1) if no, then incrementing, step 100, a minimum timer, and proceeding to step c,
   b2) if yes, then, step 92, setting the minimum value to the current indicated fuel level, setting the minimum timer to an initial count, and setting a stored maximum value to the maximum value of step a, and proceeding to step c,
c) determining, step 96,
   c1) if the minimum timer has timed beyond a designated timer threshold, and
   c2) if the maximum value is greater than the stored maximum value plus a designated difference threshold,
   c3) and if yes to both c1 and c2, link 98, then proceeding to step d,
d) determining, step 102, if the indicated fuel level is greater than the given fill level, and if so, outputting the alert signal, step 104.

The method includes, if either c1 or c2 is no, then, link 106, returning to step a. The method includes, as a pre-step, prior to step a at 88, determining, step 84, if the engine is running, and if no, than proceeding to step a at 88, and if yes, then repeating the pre-step 84. The method includes: providing reset parameters, step 86, for the minimum and maximum values according to a prior cycle of the loop, e.g. the immediately preceding cycle; and prior to step a at 88, setting, step 86, the minimum and maximum values to the reset parameters. The method includes: providing a fuel fill detection method 80 at steps a through c; and providing an overfill alert method 82 at step d.

The control circuit 40 including at CPU 42, ROM 44, RAM 46, includes a computer-readable medium having computer-executable instructions for performing the above noted method, including the steps set forth above.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

What is claimed is:

1. A method for avoiding overfilling a marine fuel tank in a marine fuel system for a marine internal combustion engine for a vessel in a body of water and subject to movement, including due to waves, rough water, people moving on the vessel, and so on, said fuel tank containing fuel subject to sloshing action due to said vessel movement, said fuel tank having a fuel filler inlet for adding fuel to said fuel tank, and a fuel level sensor outputting, a fuel level signal, said method comprising:

receiving said fuel level signal and discriminating between condition A comprising an increase in the true amount of fuel in said fuel tank above a given level, and condition B comprising, a transient increase in the level of fuel in said fuel tank at said sensor above said given level due to said vessel movement;

outputting an alert signal in response to condition A and not to condition B.

2. The method according to claim 1 comprising reading condition A as a true-fill to said given level, and reading condition B as a false-fill and avoiding false triggering of said alert signal.

3. The method according to claim 2 comprising supplying said fuel level signal from said sensor to a fuel gauge in said vessel at a location not readily observable by an operator adding fuel to said fuel tank at said fuel filler inlet, and actuating an alarm in response to said alert signal and alerting said operator thereto regardless of said operator's observation or non-observation of said fuel gauge.

4. The method according to claim 3 comprising emitting an audible alert from said alarm in response to said alert signal.

5. The method according to claim 1 comprising determining if said engine is running and if fuel level in said fuel tank is increasing at a rate that can only be done during fueling without sloshing due to said vessel movement, and comparing current fuel level to said given fuel level, and outputting said alert signal when said given fuel level is met.

6. The method according to claim 1 comprising:

determining current fuel level in said fuel tank, determining if said current fuel level minus a previous fuel level is less than a threshold, and if yes determining if said engine is running, and if no determining if said current fuel level is greater than said given fuel level, and if yes outputting said alert. Signal.

7. The method according to claim 1 comprising filtering said filet level signal from said sensor to prevent false triggering of said alert signal by said transient increase.

8. The method according to claim 1 comprising entering a loop tracking minimum and maximum fuel levels indicated by said fuel level signal from said fuel sensor, and if the indicated fuel level has not dropped below a minimum value for a given interval, and if the indicated fuel level has increased by a designated amount above a maximum value, then deeming said system to be in a filling mode, and outputting said alert signal when said indicated fuel level rises above a given fill level.

9. The method according to claim 8 comprising:

a) determining if the indicated fuel level is greater than a maximum value, and a1) if yes, then setting the maximum value to the current indicated fuel level, and proceeding to step b, a2) if no, then proceeding step b, b) determining if the indicated fuel level is less than a minimum value, and b1) if no, then incrementing a minimum timer, and proceeding to step c, b2) if yes, then setting the minimum value to the current indicated fuel level, setting the minimum timer to an initial count, and setting a stored maximum value to the maximum value of step a, and proceeding to step c, c) determining:

c1) if the minimum timer has timed beyond a designated timer threshold, and c2) if the maximum value is greater than the stored maximum value plus a designated difference threshold, c3) and if yes to both c1 and c2, then proceeding, to step d, d) determining if the indicated fuel level is greater than said given fill level, and if so, outputting said alert signal.

10. The method according to claim 9 comprising:

if either c1 or c2 is no, then returning to step a.

11. The method according to claim 9 comprising:

as a pre-step prior to step a, determining if said engine is running, and if no, then proceeding to step a, if yes, then repeating said pre-step.

12. The method according to claim 11 comprising:

providing reset parameters for said minimum and maximum values according to a prior cycle of said loop; and prior to step a, setting, said minimum and maximum values to said reset parameters.

13. The method according to claim 9 comprising:

providing a fuel fill detection method at steps a through c;

providing, an overfill alert method at step d.

14. A marine fuel system for a marine internal combustion engine for a vessel in a body of water and subject to movement, including due to waves, rough water, people moving on the vessel, and so on, comprising a fuel tank containing fuel subject to sloshing action due to said vessel movement said fuel tank having a fuel filler inlet for adding fuel to said fuel tank, and a fuel level sensor outputting a fuel level signal, a discrimination control circuit having a processor, a memory, and an input/output interface, wherein the discrimination control circuit:

receives said fuel level signal and discriminates between condition A comprising an increase in the true amount of fuel in said fuel tank above a given level, and condition B comprising a transient increase in the level of fuel in said fuel tank at said sensor above said given level due to said vessel movement;

outputs an alert signal in response to condition A and not to condition B.

15. The marine fuel system according to claim 14 wherein said discrimination control circuit reads condition A as a true-fill to said given level, and reads condition B as a false-fill and avoids false triggering of said alert signal.

16. The marine fuel system according to claim 15 wherein said sensor also supplies said fuel level signal to a fuel gauge in said vessel at a location not readily observable by an operator adding fuel to said fuel tank at said fuel filler inlet, and comprising an alarm actuated by said alert signal and alerting said operator thereto regardless of said operator's observation or non-observation of said fuel gauge.

17. The marine fuel system according to claim 16 wherein said alarm emits an audible alert in response to said alert signal.

18. The marine fuel system according to claim 14 wherein said discrimination control circuit determines if said engine is not running and if fuel level is increasing at a rate that can only be done during fueling without sloshing due to said vessel movement, and compares current fuel level to said given fuel level, and outputs said alert signal when said given fuel level is met.

19. The marine fuel system according to claim 14 wherein said discrimination control circuit determines current fuel level in said fuel tank determines if said current fuel level minus a previous fuel level is less than a threshold, and if yes determines if said engine is running, and if no determines if said current fuel level is greater than said given fuel level, and if yes outputs said alert signal.

20. The marine fuel system according to claim 14 wherein said discrimination control circuit filters said fuel level signal to prevent false triggering of said alert signal by said transient increase.

21. The marine fuel system according to claim 14 wherein said discrimination control circuit enters a loop tracking minimum and maximum fuel levels indicated by said fuel level signal from said fuel sensor, and if the indicated fuel level has not dropped below a minimum value for a given interval, and if the indicated fuel level has increased by a designated amount above a maximum value, then deems said system to be in a filling mode, and outputs said alert signal when said indicated fuel level rises above a given fill level.

22. The marine fuel system according to claim 21 wherein said discrimination control circuit a) determines if the indicated fuel level is greater than a maximum value, and a1) if yes, then sets the maximum value to the current indicated fuel level, and proceeds to step b, a2) if no, then proceeds step b, b) determines if the indicated fuel level is less than a minimum value, and b1) if no, then increments a minimum timer, and proceeds to step c, b2) if yes, then sets the minimum value to the current indicated fuel level, sets the minimum timer to an initial count, and sets a stored maximum value to the maximum value of step a, and proceeds to step c, c) determines c1) if the minimum timer has timed beyond a designated timer threshold, and c2) if the maximum value is greater than the stored maximum value plus a designated difference threshold, c3) and if yes to both c1 and c2, then proceeds to step d, d) determines if the indicated fuel level is greater than said given fill level, and if so, outputs said alert signal.

23. The marine fuel system according to claim 22 wherein said discrimination control circuit determines if either c1 or c2 is no, and if so, then returns to step a.

24. The marine fuel system according to claim 22 wherein said discrimination control circuit:

as a pre-step prior to step a, determines if said engine is naming, and if no, then proceeds to step a, if yes, then repeats said pre-step.

25. The marine fuel system according to claim 24 wherein said discrimination control circuit:

provides reset parameters for said minimum and maximum values according to a prior cycle of said loop; and prior to step a, sets said minimum and maximum values to said reset parameters.

26. The marine fuel system according to claim 22 wherein said discrimination control circuit provides a fuel till detection system at steps a through c, and provides an overfill alert system at step d.

27. A computer-readable medium having computer-executable instructions for performing a method for avoiding overfilling a marine fuel tank in a marine fuel system for a marine internal combustion engine for a vessel in a body of water and subject to movement, including due to waves, rough water, people moving on the vessel, and so on said fuel tank containing fuel subject to sloshing action due to said vessel movement, said fuel tank having a fuel filler inlet for adding fuel to said fuel tank, and a fuel level sensor outputting a fuel level signal, said method comprising:

receiving said fuel level signal and discriminating between condition A comprising an increase in the true amount of fuel in said fuel tank above a given level, and condition B comprising a transient increase in the level of fuel in said fuel tank at said sensor above said given level due to said vessel movement;

outputting an alert signal in response to condition A and not to condition B.

28. The computer-readable medium according to claim 27 including said computer executable instructions for performing said method, said method further comprising:

entering a loop tracking minimum and maximum fuel levels indicated by said fuel level signal from said fuel sensor, and if the indicated fuel level has not dropped below a minimum value for a given interval, and if the indicated hid level has increased by a designated amount above a maximum value, then deeming said system to be in a filling mode, and outputting said alert signal when said indicated fuel level rises above a given till level;

a) determining if the indicated fuel level is greater than a maximum value, and a1) if yes, then setting the maximum value to the current indicated fuel level, and proceeding to step b, a2) if no, then proceeding step b, b) determining if the indicated fuel level is less than a minimum value, and b1) if no, then incrementing a minimum timer, and proceeding to step c, b2) if yes, then setting the minimum value to the current indicated fuel level, setting the minimum timer to an initial count, and setting a stored maximum value to the maximum value of step a, and proceeding to step c, c) determining:

c1) if the minimum timer has timed beyond a designated timer threshold, and c2) if the maximum value is greater than the stored maximum value plus a designated difference threshold, c3) and if yes to both c1 and c2, then proceeding, to step d, d) determining if the indicated fuel level is greater than said given fill level, and if so, outputting said alert signal.

* * * * *